US006098378A

United States Patent [19]

Wyatt

[11] Patent Number: 6,098,378

[45] Date of Patent: Aug. 8, 2000

[54] METHOD OF PACKAGING A SINGLE MATTRESS TO A SMALL SIZE TO BE CONVENIENTLY CARRIED

[76] Inventor: Curtis Wyatt, 3300 W. Castor St., Santa Ana, Calif. 92704

[21] Appl. No.: 09/165,931

[22] Filed: Oct. 2, 1998

Related U.S. Application Data

[60] Provisional application No. 60/061,411, Oct. 3, 1997.

[51] Int. Cl.[7] ..... B65B 63/02; B65B 63/04

[52] U.S. Cl. ..... 53/430; 53/436; 53/438; 53/449; 53/118; 53/526; 53/529

[58] Field of Search ..... 206/524.8; 53/118, 53/119, 173, 174, 176, 449, 430, 436, 438, 439, 526, 528, 529, 530

[56] References Cited

U.S. PATENT DOCUMENTS

| | | | |
|---|---|---|---|
| 3,458,966 | 8/1969 | Dunbar et al. | 53/118 X |
| 3,521,424 | 7/1970 | Wirfel | 53/419 |
| 3,658,273 | 4/1972 | Chapuis | 53/118 X |
| 4,453,368 | 6/1984 | Egee | 53/430 |
| 4,602,472 | 7/1986 | Ampolini et al. | 53/438 |
| 4,711,067 | 12/1987 | Magni . | |
| 5,020,302 | 6/1991 | Buchman et al. | 53/430 |
| 5,775,059 | 7/1998 | Hampton et al. | 53/438 X |
| 5,934,041 | 8/1999 | Rudolf et al. | 53/118 |

*Primary Examiner*—Daniel B. Moon
*Attorney, Agent, or Firm*—Loeb & Loeb LLP; F. Jason Far-hadian

[57] ABSTRACT

The present invention provides an improved apparatus and method for automatically compressing, rolling, and packaging individual mattresses in a compressed state.

10 Claims, 7 Drawing Sheets

FIG. 1
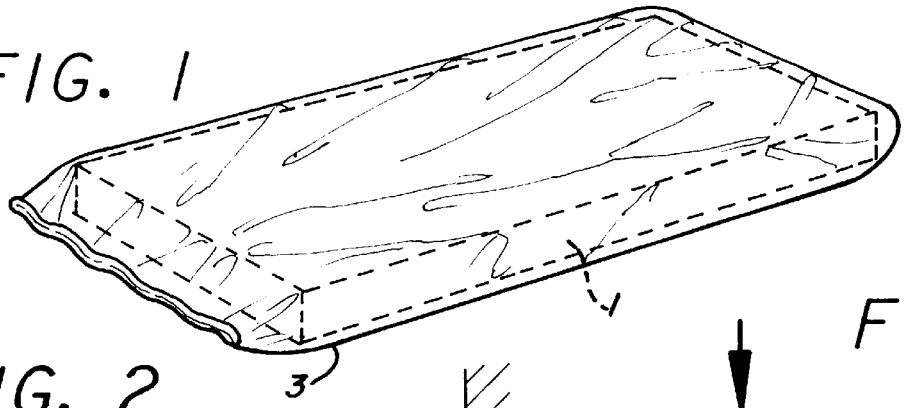
FIG. 2
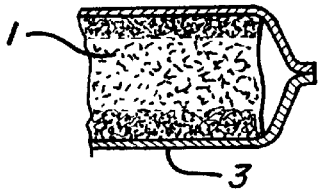
FIG. 3
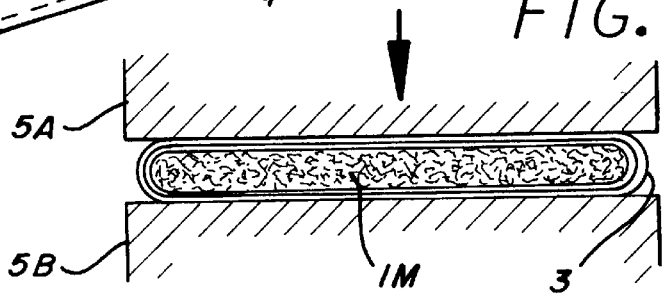
FIG. 4
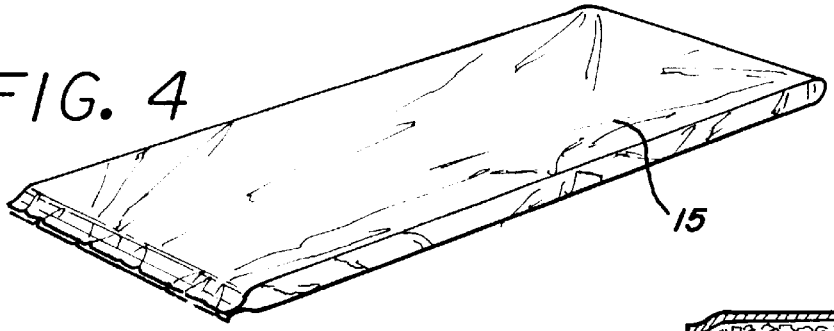
FIG. 5
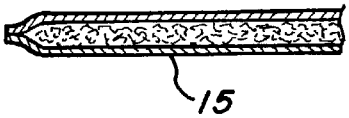
FIG. 7
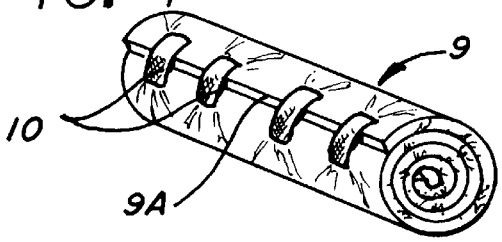
FIG. 6
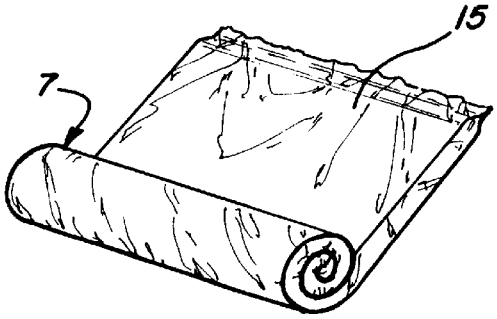
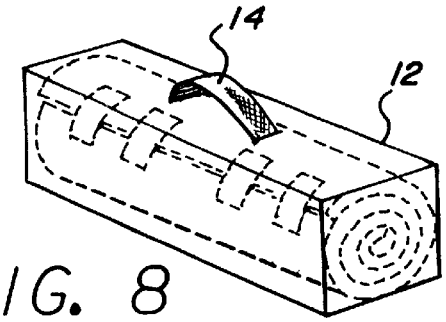
FIG. 8

211
211A
213
217
215
15
201
211
203
219
207
209
207
205
201
f207
f207
15
205

200
45
222
224
215
f215
201
226
M9
219
209
207
232

FIG. 17
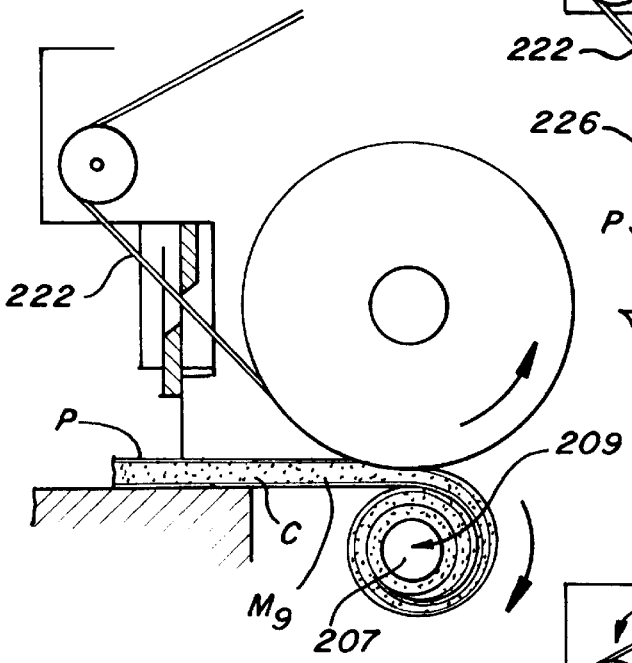
FIG. 16
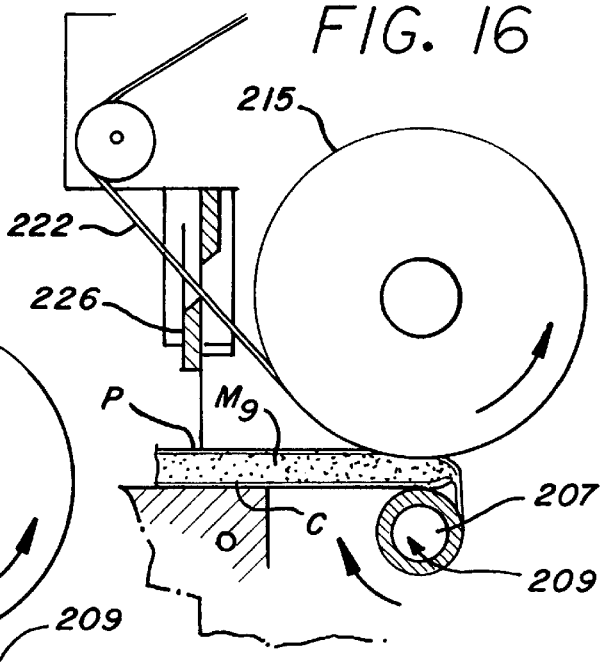
FIG. 19
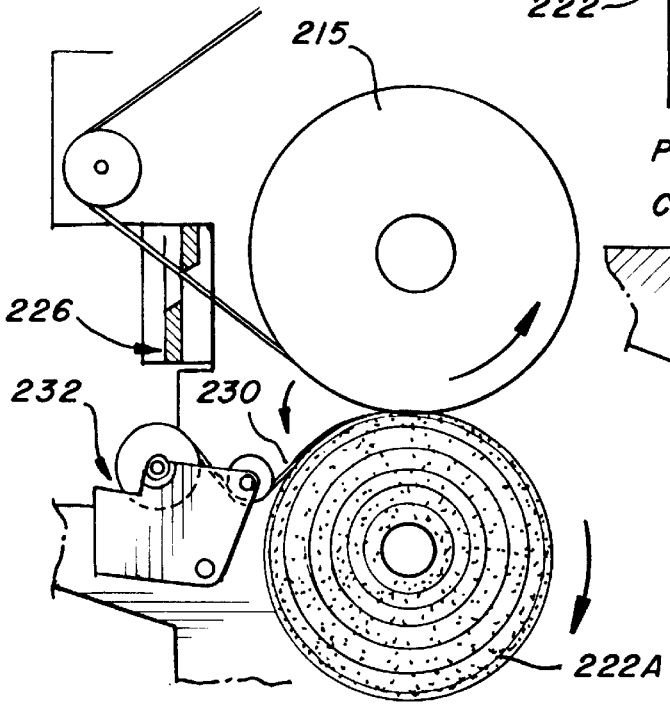
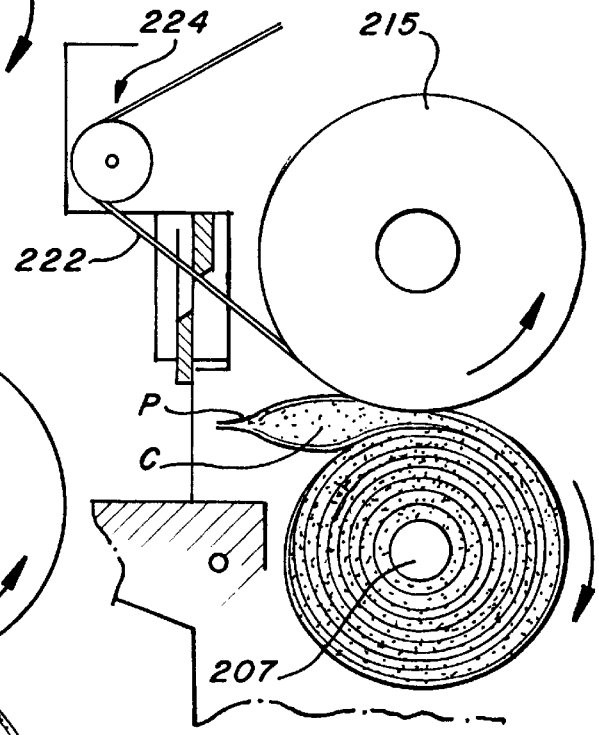
FIG. 18

METHOD OF PACKAGING A SINGLE MATTRESS TO A SMALL SIZE TO BE CONVENIENTLY CARRIED

This application claims benefit of provisional application 60/061,411 Oct. 8, 1997.

BACKGROUND OF THE INVENTION

1. Technical Field

The present invention relates to a method for individually packaging mattresses in such a way as to ensure ease of transport of the mattress and a small overall size thereof. The invention also relates to an individual mattress package.

2. Prior Art

Methods are known for the packing of spring mattresses or other modern type mattresses made with synthetic resin foam and other materials, providing for the reduction of thickness of the mattress and fixing the squeezed shape of the mattress for the simultaneous despatch of a plurality of mattresses. In the majority of cases a stack of mattresses is compressed to reduce its height and the mattresses are se cured in their squeezed shape with mechanical means such as straps or resistant wrappers. It is thus possible, within a restricted space, for example in a container, to despatch a plurality of mattresses to the point of sale, while the final user is supplied with a mattress that has again expanded.

There exist a number of systems for the reduction of the volume of pillows and the like by suction and low vacuum in a container containing a single pillow or cushion. A system of this kind cannot be adapted to the single mattress, because of technical and economic difficulties.

SUMMARY OF THE INVENTION

It is an object of the invention to provide a method of packing an individual mattress so that it occupies a small space for storage and also for the convenience of the final purchaser in carrying the mattress home.

The present invention provides a method of individually packaging a mattress including the steps of inserting the mattress into a flexible and sealable wrapper, compressing the wrapped mattress by squeezing compression means to reduce the thickness of the mattress within limits compatible with the elastic structure of the mattress, and to remove air from the inside of the wrapper, thereafter sealing the wrapper, rolling up the squeezed and sealed mattress, stabilizing the rolled up shape, and placing the rolled mattress in a container therefor.

In a preferred method compression is produced by squeezing, and the remaining air is subsequently at least partially removed by suction with a suction or vacuum pump. In other methods, welding is effected without removal of air by suction, expulsion of the air with the press being sufficient.

The wrapper shall be air-tight, and it may be double, i.e. two wrappers one inside the other, welded separately or together for sealing purposes.

The welding of the wrapper may be effected after the removal of air by suction, or in two stages, a first stage effecting a partial closure and allowing air passage during the suction operations.

The stabilization of the rolled-up shape may be produced by the use of tapes, closing rings surrounding the rolled-up mattress, or with adhesive tape which may be disposed around the rolled-up mattress or, simply, as strips applied to the outside edge which extends longitudinally of the rolled-up mattress.

The method of packing to be described may be adopted for many types of mattresses, and particularly for those which have an intermediate layer of rubber or a synthetic elastic foam resin and, possibly, outer layers of artificial or natural fibers on the surfaces ensuring the comfort of the user. A mattress of this type can resume its normal expanded, smooth shape within the space of a few hours after the wrapper which has kept it in a low vacuum has been torn off.

A preferred method includes the steps of: reducing the thickness of an elastic structure of the mattress by pressing and feeding means cantileverly projecting; fitting a cover on said structure and on said pressing means to complete the mattress, said cover comprising foam padding with inside film and a closure means; fitting a flexible and substantially air-tight wrapper on the outside of said cover; moving away the mattress with said cover and said wrapper from said pressing and feeding means; closing the cover by said closure means; flattening the mattress together with its cover and the flexible wrapper; inserting the flattened mattress between a rolling-up mandrel and a cylinder operating the compression by rolling and being elastically pushed toward said mandrel; rotating said mandrel and rolling-up on said mandrel said flattened mattress by compressing it by means of said cylinder which performs compression by rolling; circularly applying at least two adhesive ribbon-shaped strings at spaced apart positions around the rolled mattress in order to stabilize it; and axially withdrawing the mandrel from the rolled mattress and putting said mattress in a box-like container.

The invention also includes a package for an individual mattress including an outer container, a mattress, a wrapper enclosing said mattress and sealingly holding said mattress in a compressed condition, and retaining means for holding said mattress and wrapper in a rolled-up configuration, said retained, rolled and wrapped mattress being received in said outer container.

A preferred package includes an outer container, a mattress, a wrapper enclosing said mattress, said mattress and said wrapper being in a compressed and rolled-up configuration, a ribbon-shaped film coupled to said mattress and rolled up at least partially together with said mattress and enveloping the rolled mattress with at least one convolution, and at least two retaining adhesive ribbon-shaped strings applied spaced apart and circularly around this outside convolution of said ribbon-shaped film and holding this convolution and therefore said mattress and wrapper in said rolled-up configuration, said rolled and enveloped mattress being received in said outer container.

The invention also includes an apparatus for packaging single mattresses. Said apparatus includes: pressing and feeding means cantileverly projecting to reduce the thickness of said structure, the cover and the flexible wrapper being capable to fit on said means; squeezing compression means to flatten said mattress together with its cover and its flexible wrapper; a rolling-up and pressing device including axially sliding and rotating mandrel means, a compressing and rolling cylinder elastically urged towards said mandrel; means for feeding and applying at least two ribbon-shaped adhesive strings around the mattress in rolled configuration on said mandrel; and means for axially moving said mandrel means to withdraw them from said mattress being in rolled configuration.

After the mattress has been compressed and rolled, the rolled mattress can be automatically packaged into a container for shipping and storage by suitable apparatus. The container can be sufficiently strong to resist the unrolling forces of the rolled mattress for a prolonged period of time.

BRIEF DESCRIPTION OF THE DRAWINGS

FIG. 1 is a perspective view of a mattress inserted in its wrapper;

FIG. 2 is a partial section through the wrapped mattress of FIG. 1;

FIG. 3 is a section through the mattress at an intermediate stage of compression;

FIG. 4 is a perspective view of the mattress after compression;

FIG. 5 is a partial cross-section of the mattress of FIG. 4;

FIG. 6 shows a stage on the rolling up of the flattened mattress;

FIG. 7 is a perspective view of the rolled-up mattress;

FIG. 8 shows the rolled-up mattress packed in its individual packing;

FIGS. 16 to 19 show schematic views similar to FIG. 15, in different successive configurations;

DESCRIPTION OF PREFERRED EMBODIMENTS

Figure 9:
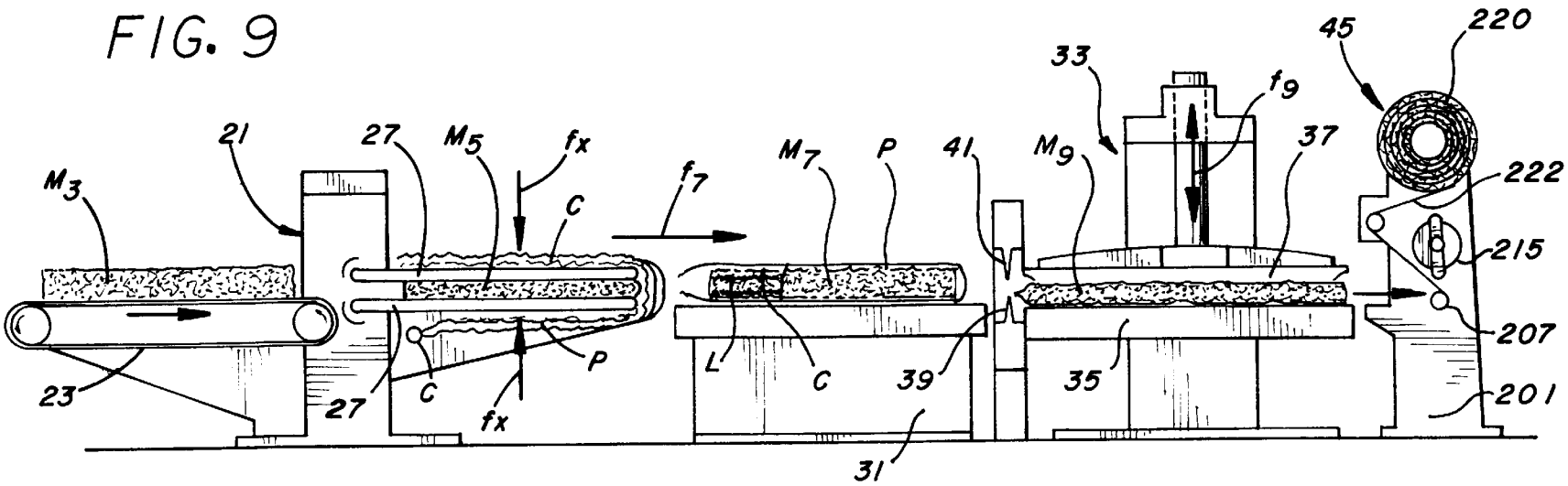
FIGS. 9 and 10 show a side view and a plan view of a production plant.

The mattress 1 is illustrated in its normal size and enclosed in an open wrapper 3 intended to house it. The wrapper is mostly made of a film of synthetic airproof, weldable material, with a consistency adequate to withstand the stresses it will be expected to undergo. This wrapper 3 may also constitute a sheath for storing the re-expanded mattress at home. The wrapper may be a double one. The mattress 1 with its sheath 3 is placed in a press 5A, 5B, which is able to compress it from the normal size denoted by 1 through a size 1M to the squeezed size denoted by 1S. Squeezing is effected by mechanical action between the two parts 5A, 5B of the press. During the pressing operation, as the wrapper 3 is still at least partly open, the greater part of the air contained in the wrapper 3 is squeezed out. Immediately after pressing, and before the action of the press has been stopped and, anyhow, before a re-expansion of the mattress, the remaining air may be removed with a suction pump or a vacuum pump from the wrapper 3 to a degree of vacuum kept within the reasonable limits for the purposes mentioned.

At the end of the squeezing and the desired suction operations, the wrapper 3 is sealed, and thereafter the mattress remains squeezed inside the wrapper without any possibility of re-expansion.

The mattress thus squeezed and secured inside the wrapper is then relatively tightly rolled up as shown at 7, until the shape shown at 9 is reached. This shape is stabilized with the application of means for holding the outside edge 9A of the mattress and its wrapper. These retaining means may be represented by two or more pieces 10 of relatively strong adhesive tape, applied transversely and facing the edge 9A. In the method and apparatus described below in reference to FIGS. 20–23, the retaining means may be a single piece of tape, one string or a single band, a non adhesive band, or any other means may be used to hold the mattress in a rolled state, such as utilizing a portion of the semi-mandrels to hold the mattress, as only temporary holding of the rolled mattress is required prior to insertion into the container 310.

In the presentation shown at 9 the squeezed mattress assumes a very limited and compact overall size and may therefore be inserted in a container 12 which may be cylindrical or parallelepipedic. This container is not intended to withstand a thrust from the inside towards the outside of the squeezed and rolled-up mattress which is stabilized by the retaining means 10. The container 12 may be of cardboard or synthetic resin, formed in the shape of a box, a cube or other shape, to be opened at the end or longitudinally. The container of this type may be advantageously fitted with a handle 14 for ease of transport in a horizontal position. It will be appreciated that various types, shapes and constructions are possible for such a container 12.

After having been rolled up, the mattress held by the retaining means may be in such a condition as to no longer require the low vacuum conditions.

Figure 10:
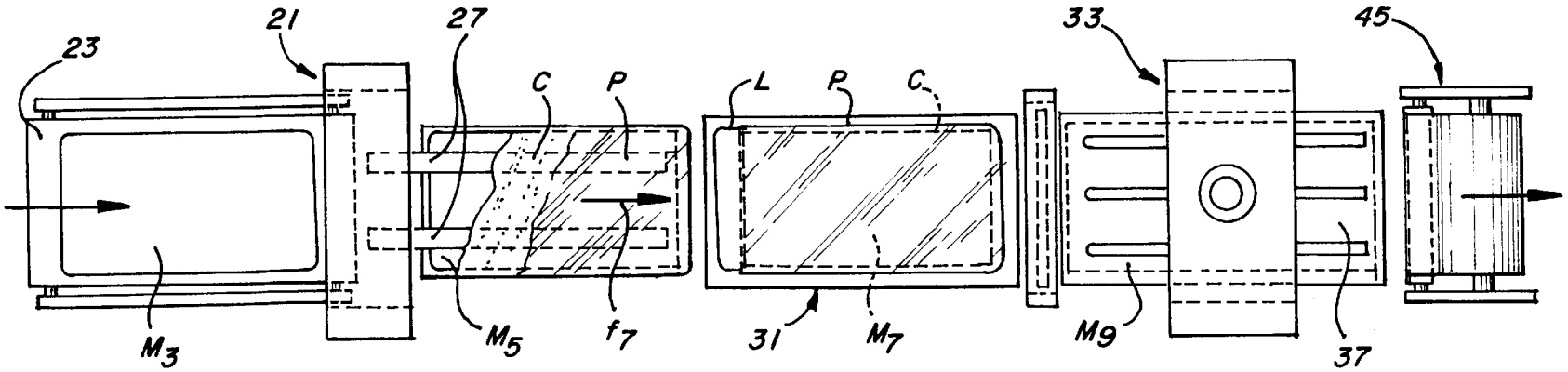
Figure 12:
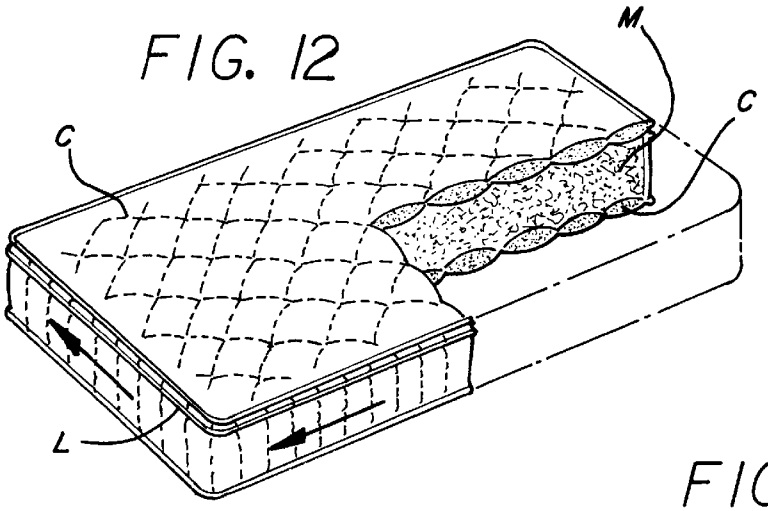
FIG. 12 shows, in a perspective view, a finished mattress with removed parts.
Figure 14:
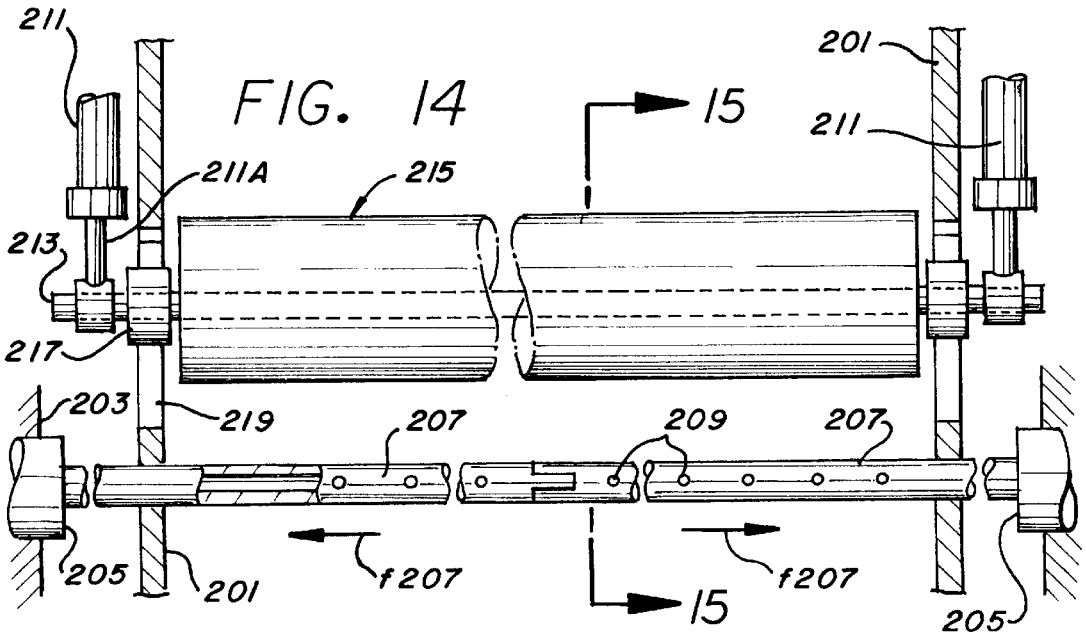
FIGS. 14 and 15 show a device for final pressing and rolling up, in schematic cross section and in a section taken along XI—XI of FIG. 14.
Figure 15:
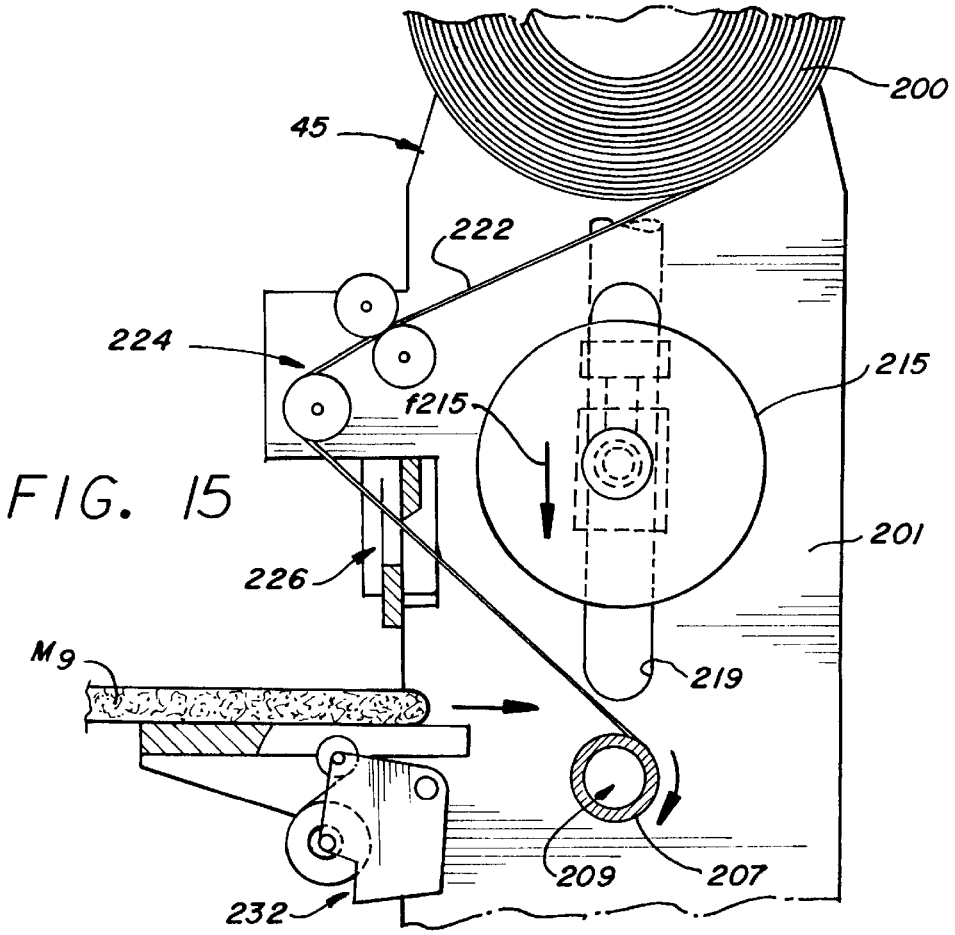
Figure 20:
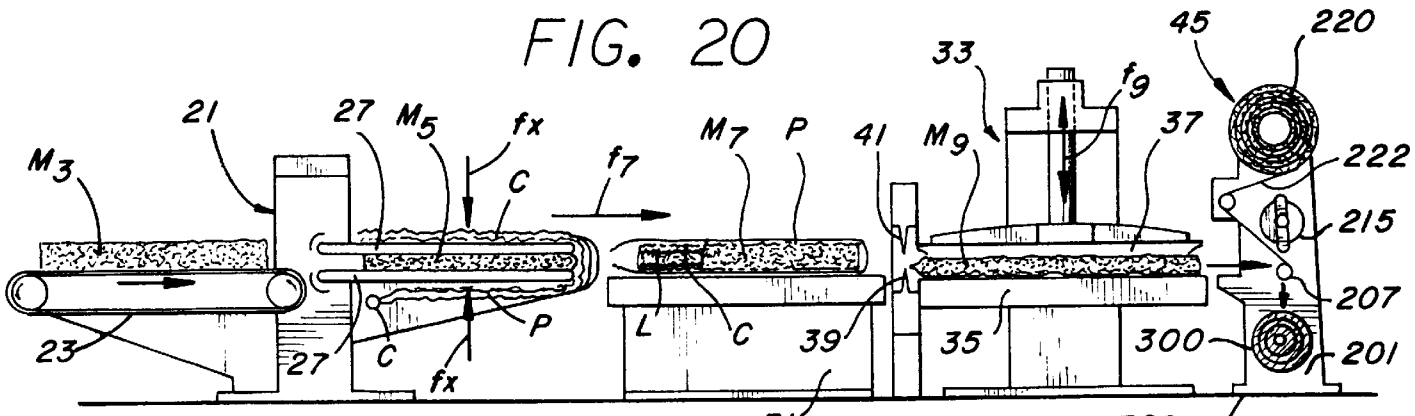
FIGS. 20 and 21 show a side view and plan view of an improved production plant for automatically placing a rolled mattress into a container.
Figure 21:
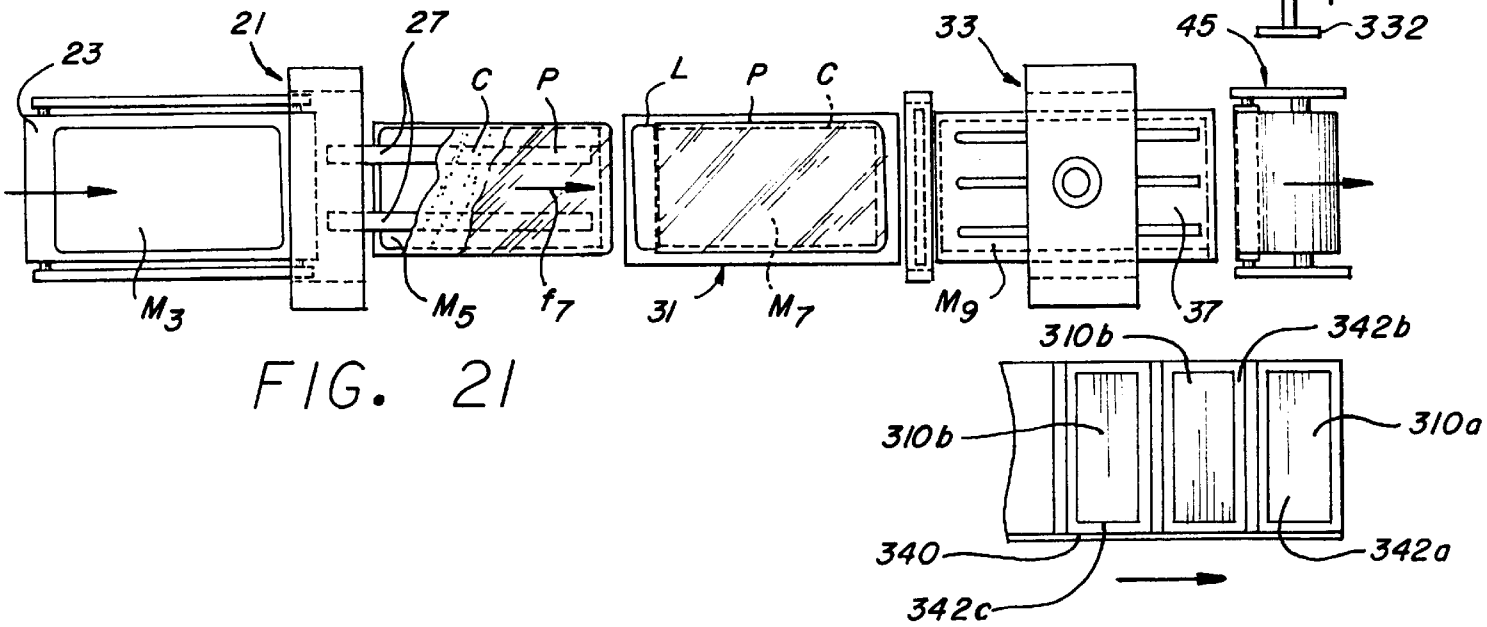
Figure 22:
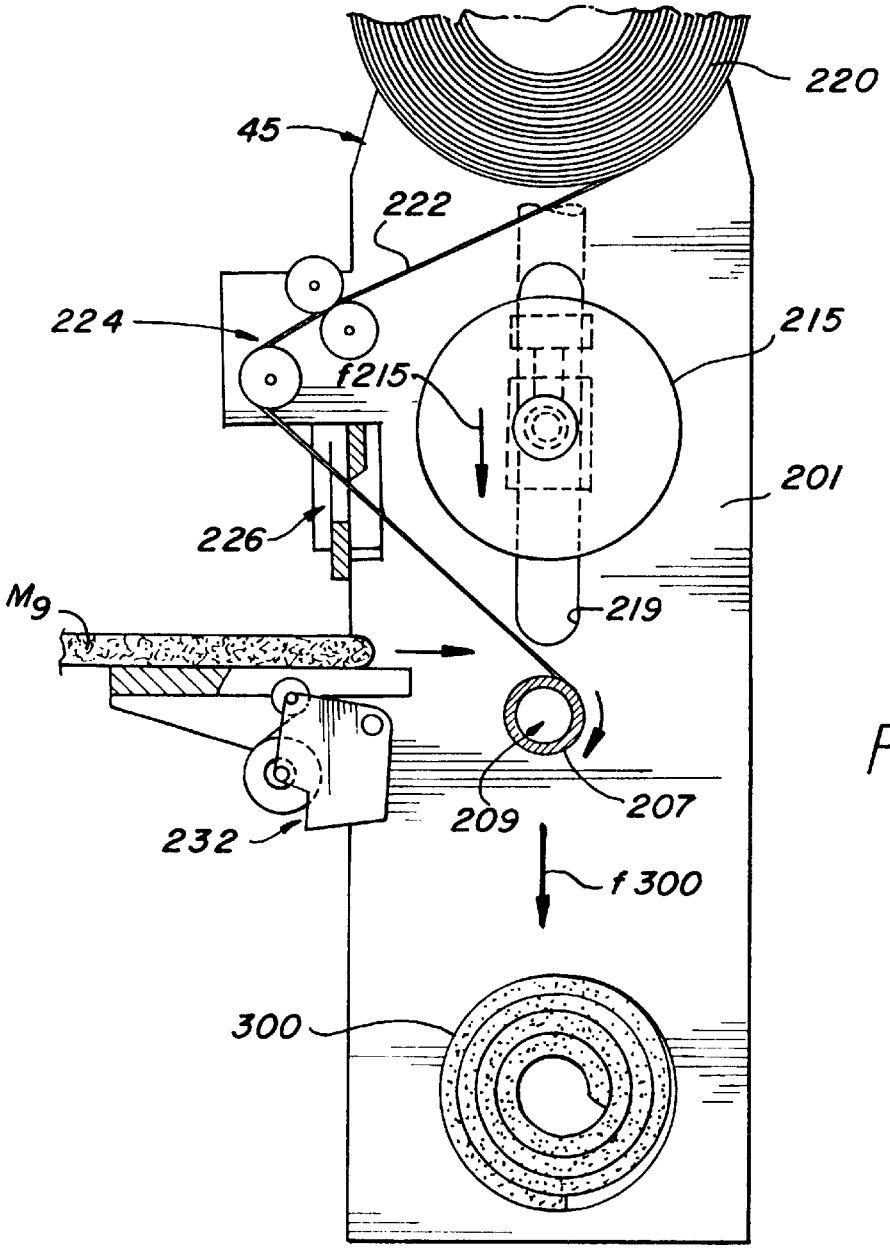
FIG. 22 is an enlarged partial side view of the production plant shown in FIG. 20.
Figure 23:
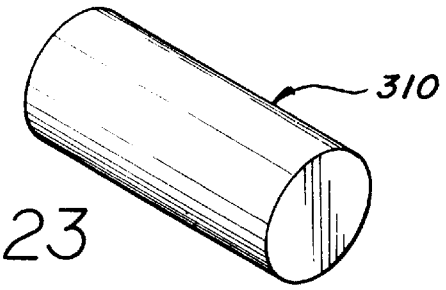
FIG. 23 is perspective view of a container for storing a mattress in a rolled state.

In FIGS. 9 and 10 a plant is shown for carrying out an intermittent working. An equipment 21, per se known, presents a conveyor 23 on which the elastic mass M3 to be packaged may be laid down; the conveyor 23 inserts the mass M3 between two sets of arms 25,27 combined with conveyors and mounted on the equipment 21 so that they can be displaced parallel to themselves according to arrows fX to get closer between them and, in opposite direction, to be moved apart. The mass M3, when it has been inserted between the arms 25 and 27, is pressed to some extent as indicated by M5 to have its thickness reduced. Under such conditions it is easy to fit on the unit, made up of arms 25,27 and on the mass M5, a cover C complete with padding and opened in correspondence of a mouth being provided with a continuous closure system L, like a so-called "zip" closure; this mouth and this closure L extend along one of the minor end fronts of the cover C and, in part, along the major sides as shown in FIG. 12; the cover C comprises also foam padding with an inside film.

Together with the cover C or immediately after, a flexible and substantially air-tight wrapper P, developed as an open sack, may be fit on the cover C; this wrapper being realizable by thermoplastic film.

The elastic mass M5 is fed according to arrow f7 together with the cover C and the wrapper P by the advancement means combined with the arms 25,27 and also by the operator's intervention, until the assembly reaches the position M7 to rest upon a work plane 31 adjacent to the equipment 21. During the dwell on this work plane 31, the operator closes the cover C by means of the closure L. The arms 25,27 may be provided with nozzles for the distribution of adhesive during the advancement of the assembly from position M5 to position M7 in order to make the inside surface of the cover C adhere on to the mass M7.

After the work plane 31, a compression means 33 follows for flattening the mattress together with its cover C and the wrapper P. This compression means includes a lower plane 35, preferably fixed, and an upper plane 37 displaceable according to the dual arrow f9 in order to lower and to press and flatten the mattress and also to be lifted therefrom. The compression means 33 reduces the thickness of the mattress to the configuration M7, causing the air outlet from the wrapper P. When the upper plane 37 is raised, even if the wrapper P has not been closed, the mattress does not tend to rapidly expand, because the air is prevented from penetrating the wrapper P owing to its substantial impermeability; the air can only enter very slowly the wrapper P in case this is not welded along the opening. The compression means 33 may be also combined with a welding system 39, 41 which, after the lowering of the upper plane 37 and the air outlet from the wrapper P, may be actuated to operate the welding.

After the compression means 33, a rolling-up and pressing device follows, generally indicated by 45 and better illustrated in FIGS. 14 to 19, in which the mattress, being in the configuration M7, is fed to be packaged in a more squeezed and rolled-up condition.

Figure 11:
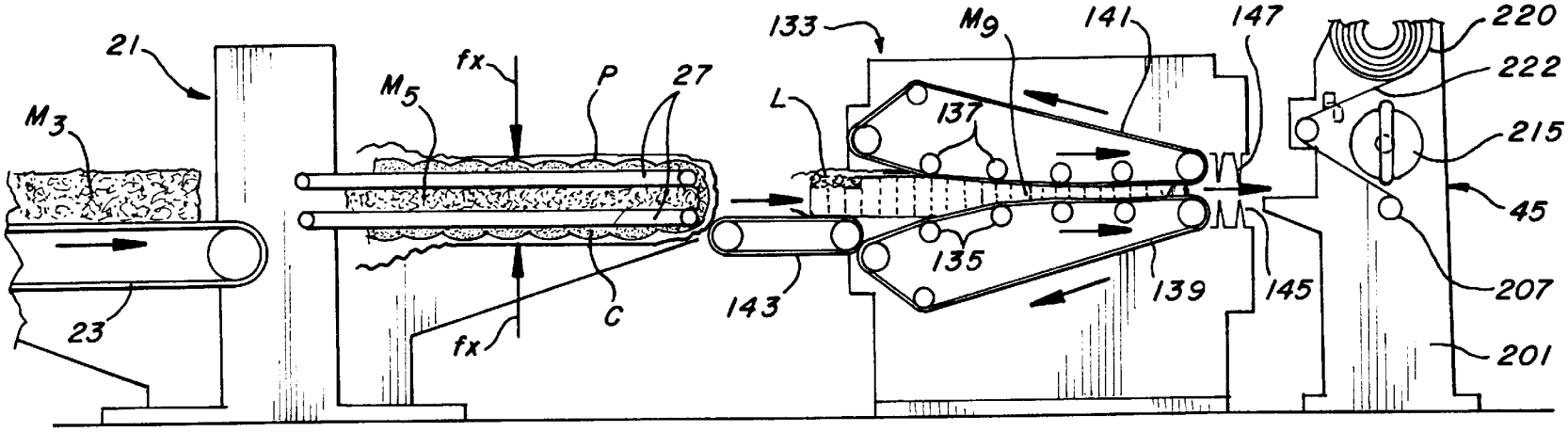
FIG. 11 shows a modified embodiment respect to FIG. 9.
Figure 13:
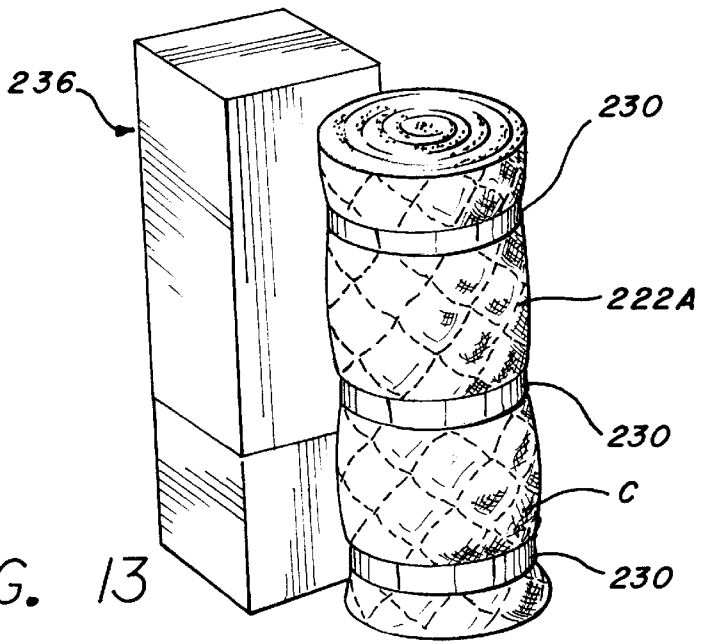
FIG. 13 shows, in a perspective view, a rolled-up mattress and a container for it.

In FIG. 11 a modified embodiment respect to FIGS. 9 and 10 is illustrated; in this embodiment, downstream and at a limited distance from the equipment 21, a compression means 133 is provided which operates in a continuous way rather than in an intermittent way like the compression means 33. As can be seen in FIG. 11, the compression means comprises two sets of lower rollers 135 and of upper rollers 137 which are advantageously associated with respective belt means 139,141, and are disposed together with them so as to result gradually closer and closer in the direction of arrow f133 of the assembly advancement. The mattress assembly, pushed out of the arms 25,27, may be slided on a short linking conveyor 143 and then delivered between the belt means 139,141, where this assembly is compressed during its advancement according to arrow f133. During the passage between arms 25,27 and the compression means 133, an operator will have enough time to operate the closing of cover C by means of the closure L. In this embodiment, the welding system may be excluded, or a welding system 145,147 may be provided at the exit from the compression means 133. The assembly, being flattened into the configuration M7 by the compression means 133, can reach the rolling-up and pressing device 45, where the mattress is packed in an even more squeezed and rolled condition.

In FIGS. 14 to 19 the rolling and pressing device 45 is illustrated in more details than in the preceding figures but, again, in a schematic way. A housing of said device comprises side frame 201 and supports 203 external to them for cylinder-piston systems 205; these systems serve to axially driving two opposite systems 207 which form two semi-mandrels each capable of sliding according to arrows f207 to axially move away from each other up the outside of the two side frames and in the reverse direction to approach to each other in order to make up a mandrel between the two side frames 201; the facing ends of the two semi-mandrels are so shaped as to cooperate when they are coupled. The two semi-mandrels are capable of rotating around their respective axis. Each semi-mandrel 207 is internally hollow to form a suction chamber through the holes 209 distributed along each semi-mandrel. On the two side frames 201, two jacks 211 are provided whose mobile parts 211A control the displacement of a shaft 213 for a compression and rolling cylinder 215; this cylinder 215 is located between the two side frames and is guided by means of supports 217 along guides 219 formed in the respective side frames. By means of the two jacks 211, the cylinder 215 may be approached towards and urged, according to arrow f215, against the mandrel formed by the two semi-mandrels 207; by a reverse drive, opposite to arrow f215, the cylinder 215 may be moved away from the mandrel. The cylinder 215 is mostly capable of rotating idly, but it could be possibly driven to rotate in a direction opposite to that of the semi-mandrels 207.

A reservoir-spool 220 feeds a ribbon-shaped film 222, which is passed through guide means 224 located in the vicinity of the cylinder 215. The end of the film 222 may be approached to the mandrel formed by the coupled semi-mandrels 207, when the cylinder is lifted (FIG. 15) and when a vacuum has been created inside the two semi-mandrels. The end of the film 222 can thus be made to adhere by pneumatic suction against the mandrel. This mandrel can be rotated according to arrow f207 just before the assembly—which has been pressed by the compression and flattening means 33 or 133—is approached to it, and immediately after the film 222 has been pneumatically engaged against the mandrel. By approaching the cylinder 215, the assembly being flattened by the means 33 or 133 is inserted between the cylinder 215 and the mandrel made up of the two coupled and rotating semi-mandrels 207 (FIG. 16) in order to start to be squeezed and rolled up (FIG. 17) together with the film 222 which results in contact with the cylinder 215. The squeezed and flattened mattress is made to assume a rolled-up configuration while the air still present in the flattened mattress is progressively driven toward the open or welded end of the wrapper P; at the end of the rolling-up (FIG. 18), the wrapper P may be even torn off by the air if the latter does not find some exit opening. The rolling-up proceeds with the film 222 only, to form at least one outside convolution 222A surrounding the rolled mattress (FIG. 19). At this point, a mechanically or even manually operated cutting means cuts the film 222 and the end stretch of the film which has been rolled up together with the mattress is laid down on the outside convolution 222A. At this point, to the outside convolution 222A of the ribbon-shaped film 222, three adhesive ribbon-shaped strings 230 are applied which are annularly disposed around the rolled mattress to stabilize the configuration of the outside convolution 222A of the ribbon-shaped film. In order to apply the ribbon-shaped strings 230, small machines 232 may be utilized of a type normally available on the market. A single small machine can be utilized by the operator for the three consecutive operations for the application of the three ribbon-shaped strings 230, while the assembly continues to rotate on the mandrel. A mobile equipment may also be provided carrying three machines 232 and which can approach them simultaneously to the rolled assembly rotating on the mandrel, for the simultaneous application of the three strings.

After the ribbon-shaped strings 230 have been applied, while the suction through the holes 209 of the semi-mandrels has stopped, said semi-mandrels stop rotating and are axially moved away from each other according to arrows f207. In this way, the semi-mandrels 207 withdraw from the inside of the mattress which is rolled up and packed by the film 222, the outside convolution 222A and the strings 230. Thus, the packed mattress can be moved away and placed in the container 236 or otherwise packaged.

It should be noted that after the packaging by the outside convolution 222A of the ribbon-shaped film 222, and after the application of strings 230, the mattress is no longer able to expand itself by sucking air, even if the wrapper P results torn off or not completely air-tight.

The rolling up may be also operated starting without the film 222 and by inserting it during the rolling up, or even without using the film and applying the ribbon-shaped strings on the wrapper P.

The mattress removed from the container may be released from the means 10 and stretched out, and the wrapper 3 may be opened in such a manner as to allow the entry of air and thus permit the re-expansion of the mattress which, more or less speedily, resumes the thickness intended for use.

As shown in FIGS. 20–23, rolled mattress 300 can be automatically packaged into a container 310 for shipping and storage. Once the rolling of rolled mattress 300 is completed, a single temporary retaining means, such as a single piece of tape, one string, a single band, or a non adhesive retainer is placed on the rolled mattress to prevent unrolling of the mattress. Alternatively, any other means for temporarily maintaining the mattress in a rolled state may be employed such as utilizing a portion of the semi-mandrels for example or other device to hold the mattress in a rolled state. Thereafter, semi-mandrels 207 separate and drop rolled mattress 300 below the plane of semi-mandrels 207 to a supporting platform 320. When rolled mattress 300 is on supporting platform 320, a piston mechanism 330, moveable in the directions of arrow A, displaces rolled mattress 300 from platform 320 into a container 310. Container 310 is aligned coaxially with the longitudinal axis of rolled mattress 300 so as to receive rolled mattress 300 as it is being displaced piston mechanism 330. Piston mechanism 330 can be advanced mechanically, pneumatically, or by any known means, and has a plunger head 332 dimensioned to fit within container 310.

One or more containers 310 can be transported parallel to rolling and pressing device 45 on a conveyor 340 such that a container 310 is automatically in position, aligned with a rolled mattress 300 present on supporting platform 320. Conveyor 340 includes segments 342 for transporting individual containers 310. Each segment 342 comprises a back portion functioning as a stop to prevent container 310 from moving relative to the conveyor 340 as piston mechanism 330 advances rolled mattress 300 into container 310.

Container 310 is dimensioned receive and contain rolled mattress 300 in a rolled state for a prolonged period of time. Container 310 is sufficiently strong to resist the unrolling forces of the mattress. As a result only a temporary retaining means is needed to prevent the mattress from unrolling prior to insertion into container 310. For example, container 310 may be a seamless cylinder of rigid construction. It is also appreciated that container 310 may have any shape suitable for receiving and storing rolled mattress 300 and may be made of any material suitable for its intended purpose such as metal, plastic, or card board, for example. After rolled mattress 300 is inserted into a container 310, container 310 may be closed with a cap to further protect rolled mattress 300 during shipping and storage.

Mattresses packed as indicated above may be stored for shipment and warehousing in a relatively very economic manner, and are saleable individually also in the packed presentation, as a result of which the final user can conveniently carry the mattress purchased with the means at his own disposal, without difficulty or extra expense.

With the above described method a mattress is obtained, which is able to re-expand in a very regular way, although being packed in a very squeezed configuration. This is, at least in part, due to the gradual compression in subsequent times, and to the way in which the compressions are carried out. The components are stabilized in their mutual position, owing both to the structure of the wrapper combined with a padding and to the possibility of gluing the mass M to the wrapper.

While the invention herein has been described by means of specific embodiments, numerous modifications and variations could be made thereto by those skilled in the art without departing from the scope of the invention set forth in the claims.

What is claimed is:

1. A method for automatically packaging individual mattresses in a compressed state, said method comprising:

inserting a mattress into a flexible and sealable wrapper;

transporting said mattress and wrapper to a compressing device;

compressing the mattress with a compressing device so that the mattress is reduced in thickness and air is removed from in between the mattress and the wrapper, sealing the wrapper enclosing the mattress therein;

transporting the mattress and the wrapper to a rolling device;

rolling up the mattress and the wrapper with the rolling device;

temporarily maintaining the rolled mattress with a temporary retaining means;

employing a piston mechanism having a plunger for automatically placing the rolled mattress into a container, wherein the container withstands the unrolling forces of the mattress for an extended period of time if the temporary retaining means are removed.

2. The method of claim 1 wherein the temporary retaining means is selected from the group consisting of a single piece of tape, one string, a single band, and a non adhesive retainer.

3. The method of claim 1 wherein the step of placing the rolled mattress in a container includes aligning the container coaxially with the longitudinal axis of rolled mattress so as to receive the rolled mattress as it is being displaced the piston mechanism.

4. The method of claim 1 wherein said piston mechanism is advanced mechanically.

5. The method of claim 1 wherein said piston mechanism has a plunger head dimensioned to fit within the container.

6. The method of claim 1 wherein providing a container includes transporting a plurality of containers parallel to the compressing device on a conveyor such that a container is automatically in position and aligned with a rolled mattress that is ready to be inserted into a container.

7. The method of claim 6 wherein the conveyor includes segments for transporting individual containers, each of the segments comprising a back portion functioning as a stop to prevent the container from moving relative to the conveyor as the piston mechanism advances a rolled mattress into a container.

8. The method of claim 1 wherein the container is a seamless cylinder of rigid construction.

9. The method of claim 1 wherein the container is made of a material selected from the group consisting of metal, plastic, or card board.

10. The method of claim 1 further comprising the step of closing the container to further protect rolled mattress during shipping and storage.

* * * * *